United States Patent [19]

Weinstein et al.

[11] 4,065,151

[45] Dec. 27, 1977

[54] RETRACTABLE SKI BINDING

[75] Inventors: Burton A. Weinstein, New York, N.Y.; Gordon C. Lipe, Teton Village, Wyo.

[73] Assignee: National Recreation Industries, Inc., Westport, Conn.

[21] Appl. No.: 662,108

[22] Filed: Feb. 27, 1976

[51] Int. Cl.[2] ..... A63C 9/08

[52] U.S. Cl. ..... 280/618; 280/637

[58] Field of Search ..... 280/637, 618, 613, 617

[56] References Cited

U.S. PATENT DOCUMENTS

| | | | |
|---|---|---|---|
| 2,959,424 | 11/1960 | Richards | 280/637 |
| 3,825,274 | 7/1974 | Weinstein | 280/637 X |
| 3,871,674 | 3/1975 | Bunn, Jr. | 280/637 |
| 3,893,682 | 7/1975 | Weinstein et al. | 280/637 |
| 3,924,866 | 12/1975 | Schweizer | 280/637 |
| 3,936,066 | 2/1976 | Witting | 280/637 |

*Primary Examiner*—Joseph F. Peters, Jr.
*Assistant Examiner*—Milton L. Smith
*Attorney, Agent, or Firm*—Fulwider, Patton, Rieber, Lee & Utecht

[57] ABSTRACT

A retractable ski binding for retaining a ski boot in normal skiing relationship on a ski, which yieldably permits separation of the boot and ski responsive to the application of abnormal forces and which has an automatic boot-to-ski return capability. A soleplate arranged for detachably mounting the ski boot is connected to the ski by an elongated, elastic leash that stretches to permit their separation and elastically contracts to draw them back together. Rigid links on the terminal ends of the leash form portions of the force-applying link between the boot and ski and engage cooperating structure on the soleplate in such a manner that the effective retention force between the boot and ski is higher when they are in close proximity to one another than when they have separated.

14 Claims, 15 Drawing Figures

20
82
24
34
84
30
26
28
96
98
100
72
22
49
47

20
82
64
62
60
34
84
32
100
72
100
80
46
30
48
26
24
28
47
36
40
22
51
49
98
96

82
64
34
70
66
72
60
62
32
24
80
4
46
28
54
30
42
36
40
42
22
44
47
49
48
38
4
98
96

52
28
24
44
48
50
22

Fig. 11
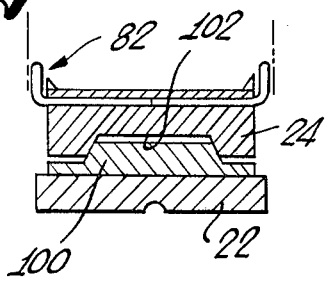
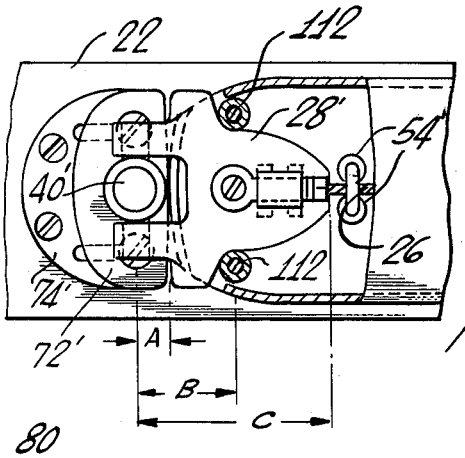
Fig. 13
Fig. 12
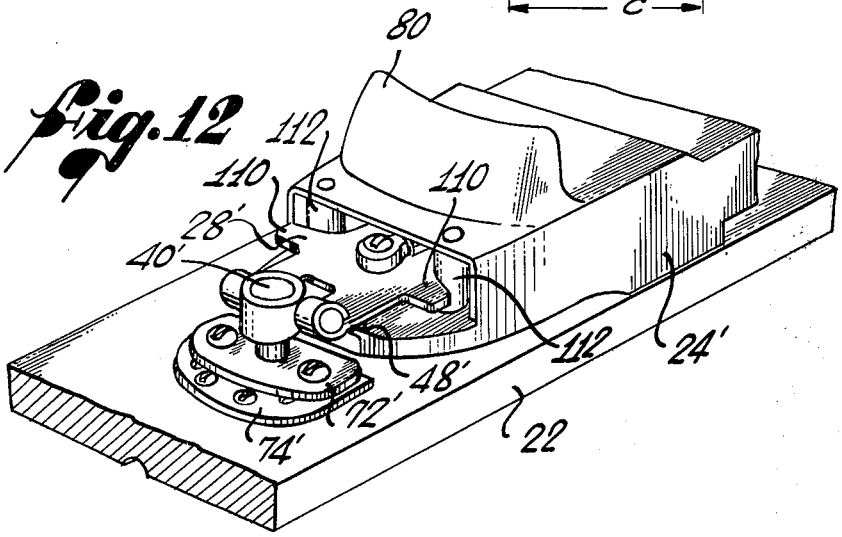
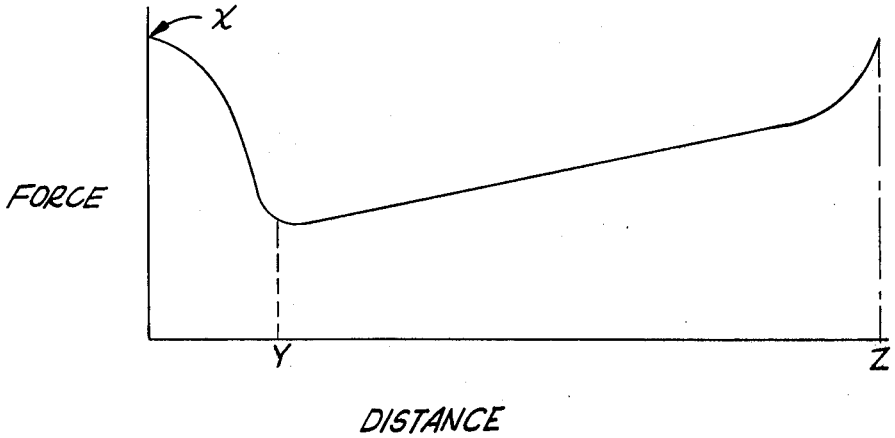
Fig. 14

RETRACTABLE SKI BINDING

CROSS-REFERENCE TO RELATED APPLICATIONS

This application is related to United States application Ser. No. 347,870, now U.S. Pat. No. 3,893,682, entitled "Releasable Safety Ski Binding Having A Self-Restoring Capability", by the inventors named in the present application, and is also related to an earlier United States application Ser. No. 255,375, now U.S. Pat. No. 3,825,274, entitled "Ski Binding With Automatic Boot-to-Ski Return", on an invention of Burton A. Weinstein, a co-inventor on the present application.

BACKGROUND OF THE INVENTION

This invention relates generally to safety-type ski bindings, and, more particularly, to ski bindings of the type which permit the boot and ski to yieldably separate when the force applied exceeds a safe level, and which also incorporate an automatic boot-to-ski return capability.

As outlined in the aforementioned U.S. Pat. No. 3,893,682, the specification of which is hereby incorporated into the present application, it is now common practice to couple a ski boot to a ski with a safety binding that allows the boot to separate from the ski in the event of an abnormal force situation which would otherwise pose a risk of injury. A wide variety of types of such bindings has been provided, and many have adjustment features to enable the break-out or release force level to be varied in accordance with the skill, physical characteristics and condition of the skier. An additional safety feature found on most types of bindings is that complete escape of the ski after release from the ski boot is prevented by the provision of various types of separate leash arrangements.

The two aforementioned patents disclose a ski binding of a type which represented a substantial departure from conventional ski binding design, in that an extensible-retractable cable serves both as a force-applying link between the boot and the ski, and as a ski-retaining leash. In U.S. Pat. No. 3,893,682, the preferred embodiment of the invention disclosed includes a soleplate detachably coupled to the boot, the soleplate carrying the operative parts of the binding, which include two connecting units, one at the heel and one at the toe. Each unit comprises an elongated, flexible leash arranged for extension and retraction, the extension being yieldably resisted by biasing means also mounted in the soleplate. The end of each leash is connected to mounting elements on the top of the ski, and force-controlling means in each unit are arranged to control the force applied to the leash as the boot moves away from the ski. Preferably, as in the disclosed embodiments in the referenced patent, a relatively high force is maintained between the boot and the ski when the boot is in close proximity to the ski, but the force decreases with separation for safety purposes.

The ski binding disclosed and claimed in U.S. Pat. No. 3,893,682 has proven to be highly satisfactory and has been accepted by skiers of all skill levels. However, there has remained a need for a ski binding having similar, desirable operating characteristics to those of the prior invention, but having even simpler construction and, as a result, a lower cost. It is to this need that the present invention is directed.

SUMMARY OF THE INVENTION

The present invention resides in an improved ski binding of the general type described above having an automatic boot-to-ski return capability. A flexible leash is utilized to transmit force between the ski boot and ski, and cooperating control means with elements on the ski and others carried with the boot engage when the boot and ski are in close proximity to achieve a relatively high retention force. Such control means operate in such a manner that the undesirable build up of the effective retention force between the boot and ski is avoided when they separate in opposition to force applied through the leash and, preferably, in a manner that the effective retention force between the boot and ski actually decreases in response to their separation.

Briefly, and in general terms, the improved binding of the invention comprises a soleplate or boot-engaging means to which the ski boot may be detachably secured, at least one mounting element affixed to the ski, a flexible leash, initially biased or prestressed to a minimum tension, and means for connecting the leash to the mounting element. The leash may, for example, comprise an elastic member with one or more resilient, stretchable elements encased in a woven mesh material, which is commonly known as "shock cord."

To provide the desired relatively high retention force when the soleplate is in close proximity to the ski, the ski binding of the invention also includes mechanical control means for varying the effective retention force between the boot and ski as a function of the extension of the leash. In general terms, this means includes means on the soleplate and cooperating means for connecting the leash to the mounting element on the ski which actually forms a part of the force-applying link. More specifically, the means on the soleplate engages the connecting means and applies a lateral force thereto if the soleplate is displaced from the ski, either sideways or vertically.

The mounting element is a universal pivot mounting to which the connecting means is attached. The location of the mounting element and the connecting means with respect to the soleplate in normal skiing position is such that lateral or vertical releasing forces on the soleplate have to be significantly greater than the initial tension in the leash in order to move the plate. This stems from the fact that the force exerted by the soleplate is transmitted through the connecting means to the leash through a relative mechanical disadvantage. As the separation of the soleplate and the ski increases, the disadvantage progressively diminishes, to bring about a corresponding decrease in the effective retention force. The connecting means finally separates entirely from the soleplate, and the soleplate is then restrained only by the flexible leash exerting a spring-like tension as determined by its stretch-resisting characteristics.

In the preferred embodiments of the invention, there are similar mounting elements at the heel and toe of the ski boot, and a single elastic leash is used, connected to the toe mounting element by one end and to the heel mounting element by the other end. The means for connecting the leash to the soleplate comprises a plurality of pulleys mounted on the soleplate, over which the leash is successively passed to increase the length of the leash between the two mounting elements, and thereby to provide a greater maximum extension than would be otherwise obtainable. The soleplate is preferably adjustable in length to accommodate various sizes of ski boot, and this adjustment serves to vary the initial tension in the leash in a desirable manner, since it is usually desirable to have a higher tension for a skier with a relatively larger boot.

In accordance with another aspect of the invention, the connecting means, which is essentially a rigid link forming an extension of the end portion of the flexible elastic leash and mounted for universal pivotal movement, is adjustable in length to provide an adjustment of the mechanical disadvantage which obtains when lateral or vertical forces are applied to the soleplate to displace it from the ski. Thus, adjustment of the length of the connecting means can be used to adjust the retention forces in effect on initial movement of the soleplate laterally or vertically from the ski.

In accordance with a related aspect of the invention, the means on the soleplate for engaging the connecting means when separating forces are applied includes a lateral force-applying means, such as a pair of ridges engaging the link on opposite sides, and an upward or vertical force-applying means, such as an upwardly facing ridge. The upward force-applying means is located closer to the mounting element on the ski than the lateral force-applying means, and therefore provides a different mechanical disadvantage for vertical release forces as compared with lateral release forces, the desired force ratio being approximately 3 or 4 to 1.

It will be appreciated from the foregoing that the present invention provides many desirable features and advantages, yet does so using a design of relative simplicity and at relatively low cost. Other aspects and advantages of the invention will become apparent from the following more detailed description taken in conjunction with the accompanying drawings.

BRIEF DESCRIPTION OF THE DRAWINGS

FIG. 11 is a cross-sectional view taken along the line 11—11 in FIG. 6;

FIG. 12 is a fragmentary perspective view of the forward or toe end of an alternate preferred embodiment of the binding of the invention shown in normal skiing relationship with an underlying ski;

FIG. 13 is a top plan view on a reduced scale of the binding as shown in FIG. 12, but with certain binding parts being broken away in order to show underlying parts more clearly;

FIG. 14 is a graphical representation of a typical force-displacement curve obtained with the binding of the invention.

DETAILED DESCRIPTION

Figure 1:
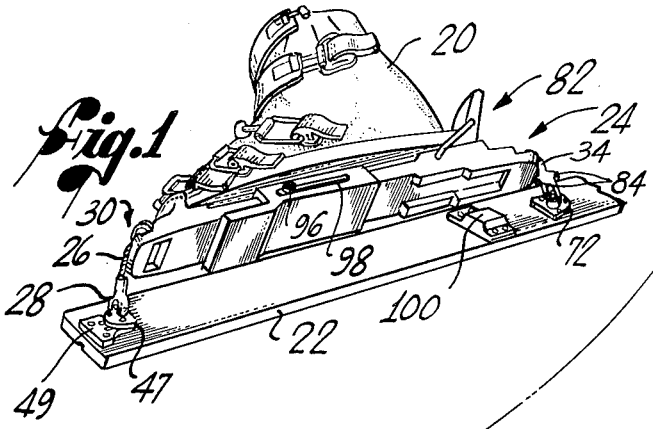
FIG. 1 is a perspective view of one preferred embodiment of a ski binding constructed in accordance with the invention and mounting a ski boot on a ski, the binding with the boot thereon being separated from the ski as when abnormal forces have been applied.

As shown in the drawings for purposes of illustration, the present invention is embodied in a ski binding for coupling a ski boot, indicated by reference numeral 20, to a ski 22, the binding being of the type which permits the boot and ski to yieldably separate when a separating force applied to either exceeds a safe level, and which also incorporates an automatic boot-to-ski return capability. The ski binding includes a soleplate 24 underlying the boot 20 and rigidly but removably attached thereto. The soleplate 24 is coupled to the ski 22 by a flexible leash 26 to provide the desired safety release and retraction capabilities.

In accordance with the invention, the leash 26 terminates in a rigid link 28 which is pivotally connected to the upper face of the ski 22, and the soleplate 24 includes a mechanical structure 30, which engages the link when the boot 20 and ski 22 are in close proximity, to achieve a relatively high retention force. The mechanical structure 30 and the rigid link 28 cooperate in such a manner that build-up of the effective retention force between the boot 20 and ski 22 is avoided when they separate in opposition to force applied through the leash 26.

Preferably, the effective retention force between the boot 20 and ski 22 initially decreases in response to their separation from a normal skiing position, as can be seen by the force-displacement graph of FIG. 14. As shown in FIGS. 1–3, 5 and 6, the leash 26 is extendable from either or both ends of the soleplate 24, which is also coupled to the ski 22 by means of a rearwardly located mechanical structure 32 on the soleplate, and a corresponding rigid link 34 at the rearward end of the leash 26. As will be explained, the rearward soleplate structure 32 and rigid link 34 cooperate in a manner similar to the corresponding elements at the front of the soleplate.

Figure 3:
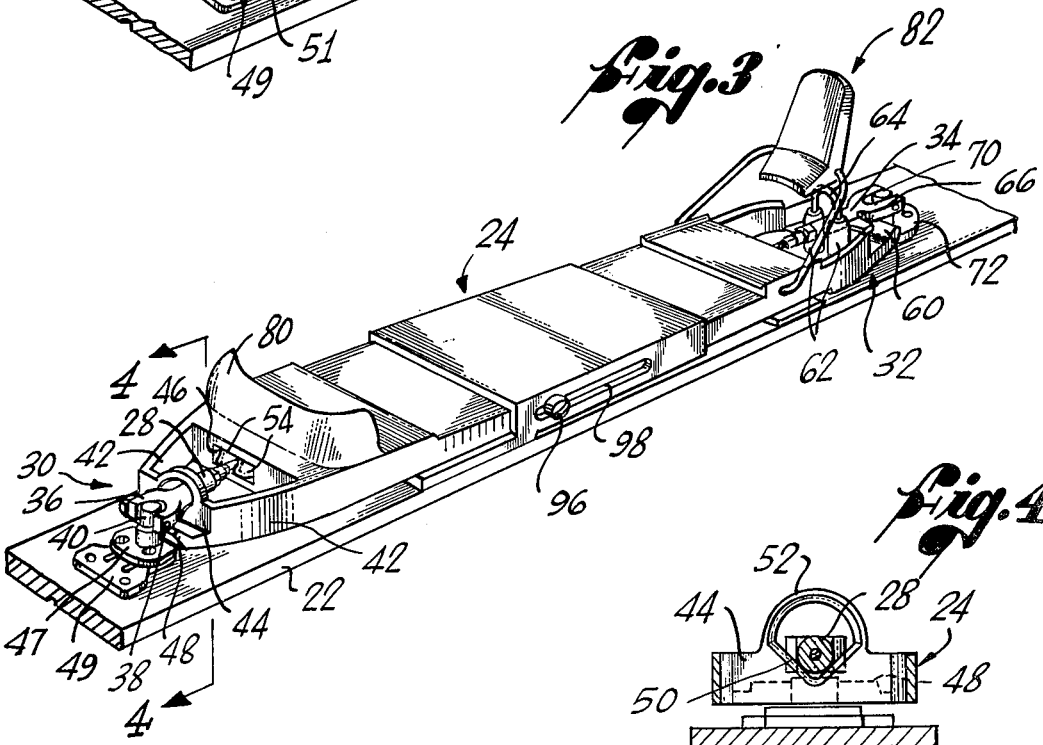
FIG. 3 is a perspective view similar to FIG. 2, except that the binding is shown in engagement with the ski in normal skiing relationship.
Figures 5, 6, 7, 8, 9, 10, 15:
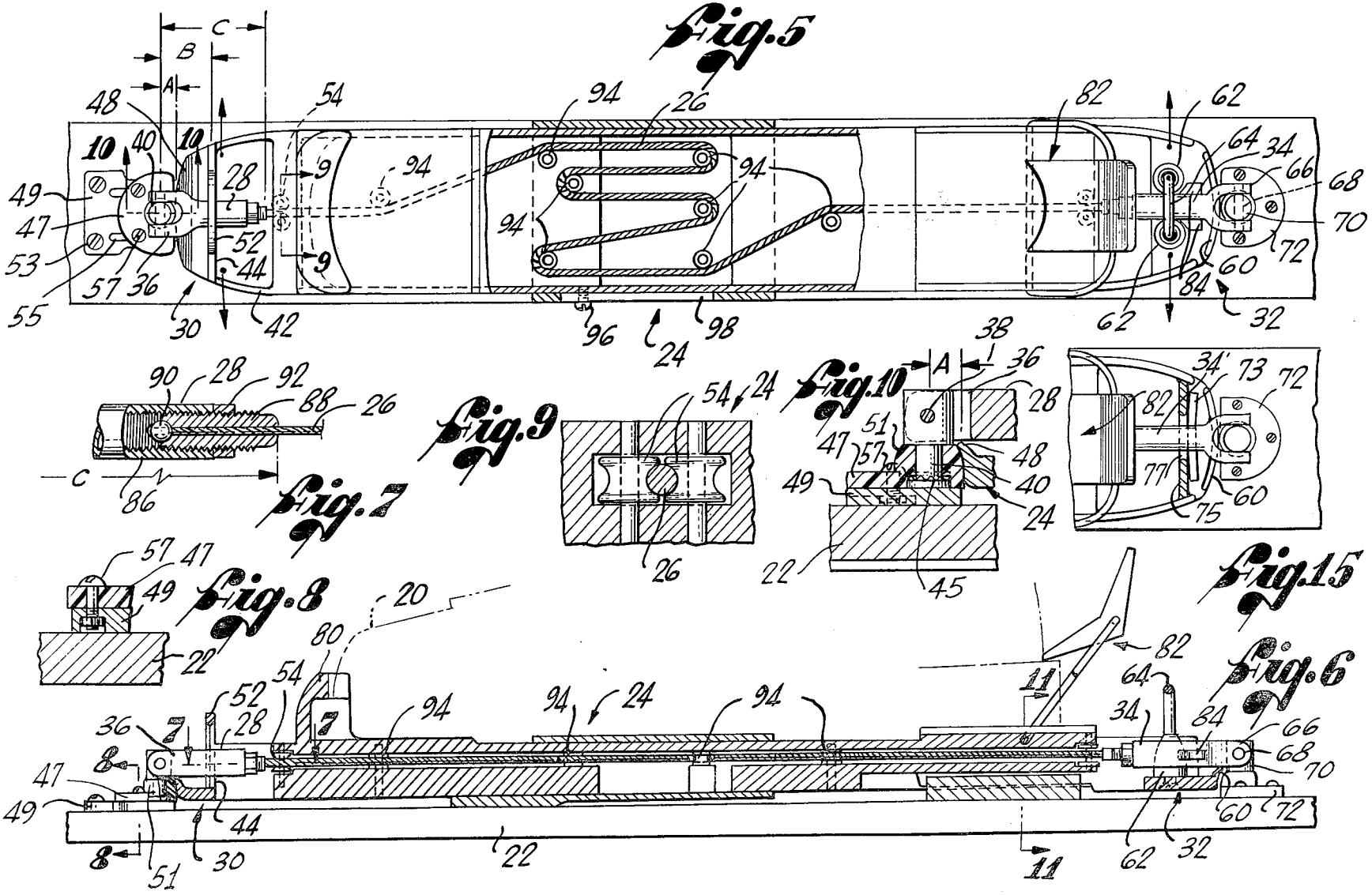
FIG. 5 is a top plan view on an enlarged scale of the binding in normal skiing position on the ski, with certain portions of the binding being broken away in order to show underlying parts.
FIG. 6 is a side view, partially in elevation and partially in cross-section, of the binding in the position shown in FIGS. 3 and 5.
FIG. 7 is a fragmentary cross-sectional view taken along the line 7—7 in FIG. 6.
FIG. 8 is an enlarged fragmentary cross-sectional view taken along the line 8—8 in FIG. 6.
FIG. 9 is an enlarged fragmentary cross-sectional view taken along the line 9—9 in FIG. 5.
FIG. 10 is an enlarged fragmentary cross-sectional view taken along the line 10—10 in FIG. 5.
FIG. 15 is a fragmentary plan view of an alternate version of certain binding elements at the heel end.

More specifically, the link 28 forms a rigid extension of the end of the leash 26, so as to comprise a part of the force-applying link between the boot and ski, and includes a shackle 36 at its remote end. A shackle pin 38 connects the link 28 to an upstanding pivot post 40 rotatably mounted on the upper face of the ski 22 (FIG. 10). Thus, the shackle 36 and pivot post 40 together form a universal mounting for the rigid link 28, permitting the link to pivot in any direction above the ski 22. At the forward end of the soleplate 24, as shown in FIG. 3, the structure 30 is basically an open frame formed integrally with the soleplate and comprising two side members 42 which are extensions of the edge portions of the soleplate, and a forward transverse member 44, which engages and cooperates with the rigid link 28.

In the embodiment illustrated, the leash 26 is secured to the ski 22 at its opposite ends and passes through the soleplate 24. Adjacent the forward end of the soleplate 24, the leash 26 emerges through an opening 46, and, when the soleplate and ski 22 are in contact in a normal skiing position, practically the entire leash is withdrawn into the soleplate. In this position, the link 28 is aligned with the ski and substantially parallel to the ski surface.

The forward member 44 of the structure 30 includes a forwardly and upwardly projecting toe 48 forming the leading portion of the entire soleplate 24. The toe 48 is located to underlie and abut the underside of the rigid link 28 in its horizontal position, and to apply an upwardly directed force thereto in the event that the forward end of the soleplate 24 is displaced upwardly from the ski 22.

Figure 4:
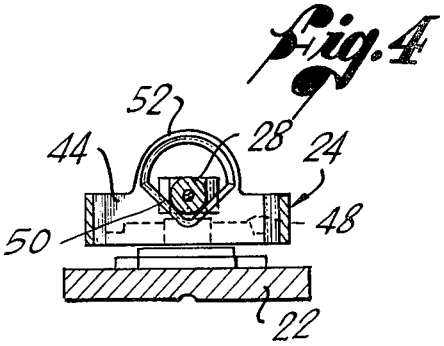
FIG. 4 is a cross-sectional view taken along the line 4—4 in FIG. 3.

As best shown in FIG. 4, the forward member 44 of the structure 30 is shaped to define a generally V-shaped notch 50 which is sized and positioned to engage the link 28 with contact on both sides when the link is in its substantially horizontal position. Simultaneous contact of the link 28 with the upwardly projecting toe 48 and the spaced ridges defining the V-notch 50 is insured by mounting the pivot post 40 for limited vertical movement. Reference is made to FIG. 10, where it may be seen that the pivot post 40 is mounted for such movement, as well as for rotation, and is normally biased down toward the ski by a spring washer 45. It will thus be understood that the pivot post 40 moves upwardly as necessary in opposition to the spring force to insure the desired contact between the link 28 and the toe 48 and between the link and the ridges of the V-notch 50.

Mounting of the pivot post 40 on the ski is accomplished by an assembly including upper and lower mounting plates 47 and 49. Integrally formed with the upper plate is a stop sleeve 51 that receives the pivot post 40 and supports the same for rotation and limited vertical movement (FIG. 10). The lower plate 49 is secured to the ski as by screws 53, and the upper mounting plate 47 is arranged to be adjustable longitudinally with respect to the ski to accommodate adjustments of the soleplate 24 to fit different boots and suitably establish the force urging the soleplate 24 against the stop sleeve 51. As shown in more detail in FIGS. 5 and 8, the lower mounting plate 49 is slotted, as at 55, to receive mounting bolts from the upper plate 47, each mounting bolt 57 having a corresponding nut retained in a recess on the underside of the lower mounting plate 49. By this means, the position of the forward pivot post 40 can be adjusted in a direction longitudinally of the ski.

The forward member 44 of binding structure 30 also includes an integral raised arch or fairlead 52 over the V-notch 50 and spaced substantially above the link 28 in its horizontal position. As will be seen (FIG. 2), the fairlead 52 acts to retain and guide an extended portion of the leash 26 when the soleplate 24 is displaced from the ski 22.

As best viewed in FIG. 9, the soleplate 24 mounts at the opening 46 a pair of guide pulleys 54 mounted on parallel vertical axes, the pulleys serving to minimize friction and being shaped to accommodate the leash 26 and prevent its lateral or vertical displacement at the opening 46.

It will be understood from the foregoing that, if the front of the soleplate 24 is displaced upwardly with respect to the ski 22, an upward force will be applied to the rigid link 28 through the forward toe 48 of the soleplate so as to cause it to swing up. Similarly, if the front of the soleplate 24 is displaced sideways with respect to the ski 22, a force acting in a horizontal direction will be applied to the link 28 through one of the sides of the V-notch 50 to cause the link to pivot out toward the edge of the ski. Since very little of the leash 26 protrudes through the opening 46 to the juncture with link 28 when the soleplate 24 is in the normal skiing position, any lateral or vertical displacement of the link 28 will initially bend the leash by an angle of almost ninety degrees at the opening 46. Accordingly, tension force in the leash 26 will be applied to the link 28 substantially perpendicularly, and applied at the end of the link remote from the associated pivot post 40. Acting in opposition to this retention force will be a separation force applied by the soleplate to the link through the V-notch 50, the toe 48, or both.

The mechanical advantage, or in this case disadvantage, in connection with a separation force through the V-notch 50 or the toe 48 can be determined by considering the link 28 to be a simple lever pivoted at the pivot post 40. In particular, if the distance from the pivot axis to the toe 48 is designated A (FIG. 5), the distance from the pivot axis to the V-notch 50 is designated B, and the overall length of the link measured from the pivot axis is designated C, then the mechanical disadvantage of applying a separating force through the toe 48 is given by the ratio C/A, and the mechanical disadvantage of applying a separating force through the V-notch is given by the ratio C/B. If the force required to bend the end portion of the leash 26 is neglected, and the initial tension in the leash is T, then the initial retention force when displacement of the soleplate 24 is vertical is given by the expression CT/A, and the retention force when displacement of the soleplate is horizontal is given by the expression CT/B.

It is an important aspect of the present invention that the effective retention force for vertical displacement between the ski 22 and the boot 20 and soleplate 24 is substantially greater than the effective retention force for lateral or sideways displacements between the ski and soleplate. Typical dimensions employed in the embodiment illustrated in FIGS. 1–11 are: $A = 0.5$ inch, $B = 1.5$ inch, and $C = 3.0$ inches. Substituting in the aforementioned retention force formulas, it can be seen that the ratio of vertical tension force to horizontal or lateral retention force is 3 to 1.

The foregoing expressions are, of course, only for the initial retention forces, before the soleplate 24 has been displaced from the ski 22. It can be seen from the expressions, however, that, by a suitable selection of the dimensions A, B and C, the initial retention force can be made to be substantially higher than the initial tension in the leash 26. It should also be apparent, that as the soleplate 24 becomes displaced from the ski 22, the point of contact between the soleplate and the link 28 will move progressively further from the axis of the pivot post 40. Stated another way, the toe 48 and the V-notch 50 will slide along the link 28 away from the pivot post 40 and, in so doing, will reduce the mechanical disadvantage of applying a separation force through the toe or V-notch, and will thereby rapidly decrease the effective retention force on the soleplate.

This force vs. distance characteristic is illustrated by the curve of FIG. 14, wherein the initial retention force is substantially high, but falls off fairly rapidly as the soleplate 24 is displaced from the ski 22. Once the link 28 has completely disengaged the structure 30 of the soleplate 24, the retention force is determined solely by the tension in the leash 26. As shown in FIG. 14, and as is true of most resilient elements, this tensile force increases with increasing displacement.

In the presently preferred embodiments of the invention, the leash 26 comprises one or more resilient, stretchable elements encased in a woven mesh material and commonly known as "shock cord". Suitable shock cord material is available from William B. Bliss Jr. & Co. of New York, New York. Such a leash may be prestressed to provide an initial tensile force in the position in which the soleplate 24 is in a normally retracted position on the ski 22. As the leash 26 is substantially stretched by ski separation forces, the loading does not significantly increase until the outer mesh material encasing the resilient elements is also stressed by tensile forces. When this occurs, the effective tension in the leash 26 increases significantly and rapidly from a relatively low rate of increase, as shown in FIG. 14. The invention is not limited to the use of shock cord as the leash material, although it affords significant advantage, and a flexible but non-stretchable cord may be used in combination with other resilient elements within the soleplate 24 to apply the desired tension.

The rearward structure 32 on the soleplate 24 cooperates with the rearward rigid link 34 in much the same way as has been described with respect to the forward structure 30 and the forward rigid link 28. The rearward structure 32 includes a rearwardly and upwardly projecting toe 60, and a pair of tapered guideposts 62 mounted forwardly of the toe 60 on parallel vertical axes, the posts being tapered to provide cooperating surfaces which fulfill the same function as the ridges defining the V-notch 50, i.e., the rearward rigid link 34 fits snugly between the guideposts when the link is in its substantially horizontal position. The rearward structure 32 also includes a leash-retaining arch element or fairlead 64 bridging the tops of the guideposts 62, and spaced substantially from the link 34 in its horizontal position.

When the rearward end of the soleplate 24 is displaced upwardly from the ski 22, the separating force is applied to the link 34 through the toe 60, and when the rearward end of the soleplate is displaced horizontally from the ski, the displacement force is applied to the link through one of the guideposts 62. The same dimensional relationships described for the displacement of the front end of the soleplate 24 also apply for displacement of the rear or heel end of the binding.

The rearward rigid link 34 also includes a shackle 66 which is pivotally attached by a shackle pin 68 to an upstanding pivot post 70 mounted on the upper surface of the ski 22. Mounting on the ski is achieved with a mounting plate 72 attached as by screws to the ski.

The soleplate 24 is held in proper registration with the ski 22, in part by the cooperation of the guideposts 62 with two laterally extending wing elements 84 on the rearward rigid link 34. The guideposts 62 have outer sleeves of a resilient material, such as natural or synthetic rubber, and the wing elements 84 are located on the link 34 such that, when the link is in its substantially horizontal position, the wing elements press forwardly against the guideposts 62, and slightly deform their resilient outer sleeves. The resilient sleeves of the guideposts 62 acts as springs to urge the soleplate 24 forwardly with respect to the ski 22, so that the forward toe 48 of the soleplate abuts the stop sleeve 51 on the ski, as best shown in FIG. 10. The stop sleeve 51 and, hence, the mounting plate of which the sleeve is a part, is preferably made from a high-strength plastic material having a low coefficient of friction, such as the plastic sold under the name Delrin, in order not to impair displacement of the soleplate 24.

Figure 2:
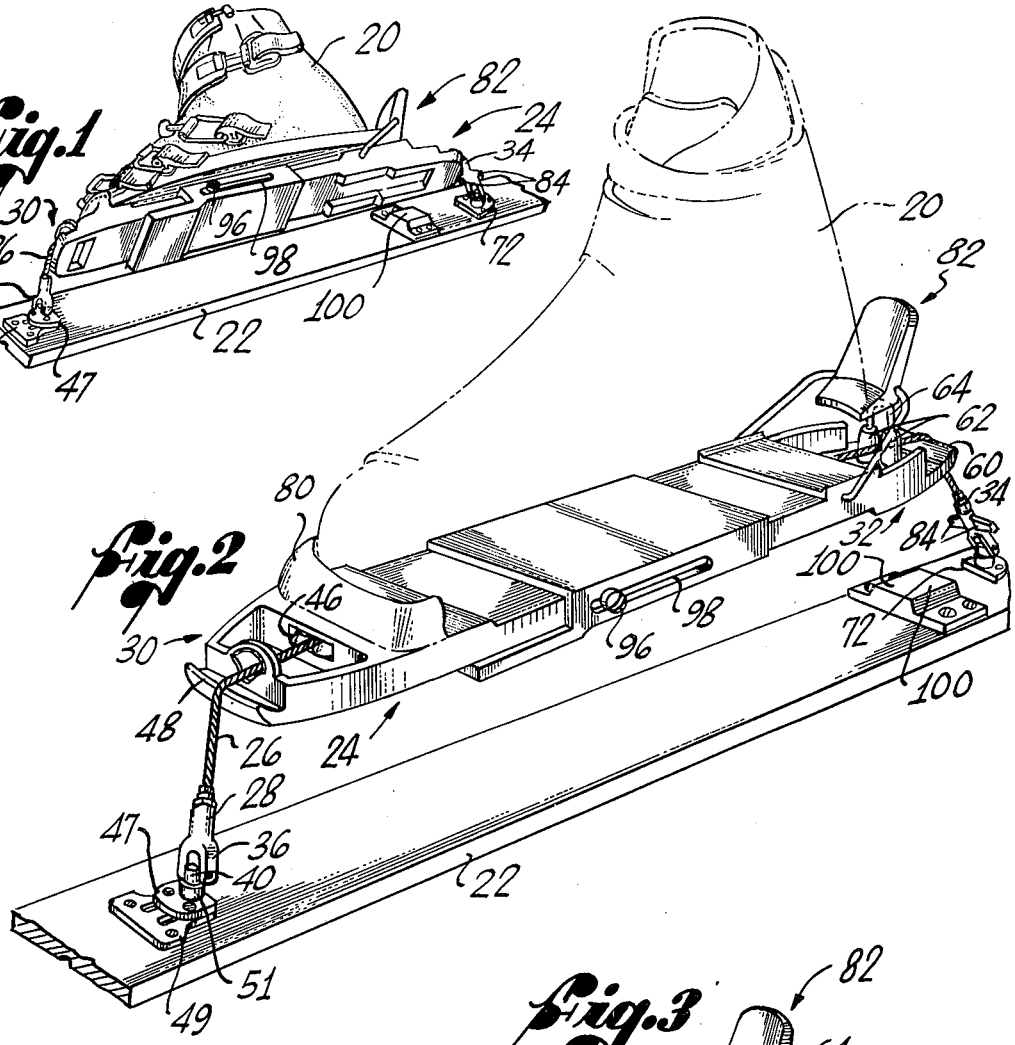
FIG. 2 is a perspective view similar to FIG. 1, but on an enlarged scale and with the binding and associated ski again separated from one another but in a different relative orientation in order to show binding components more clearly.

Alternate structure for achieving the desired forward thrust on the soleplate 24 is illustrated in FIG. 15. The resilient guideposts 62 on the soleplate are omitted and replaced with a V-notch and fairlead arrangement identical to that at the forward end of the binding, as illustrated in FIGS. 2, 3 and 4 and designated by numerals 50 and 52. A leaf spring 73 is mounted on a rear link 34' and engages a transverse member 75 on the soleplate defining a V-notch 77. Loading of the spring 73 deflects it (as shown in FIG 15) and urges the soleplate forwardly with respect to the ski.

The leash 26 may, by way of example, have a capability of stretching to twice its initial pre-loaded length. Assuming that the leash was initially 14 inches long, the available extension at both the toe and heel ends of the soleplate 24 would be seven inches assuming simultaneous and equal separations. As will be understood, should the soleplate 24 remain in place on the ski or move a reduced distance at one of its ends, then the possible displacement at the other end is correspondingly increased.

Assuming that the initial preloading on the leash 26 is about 20 pounds, then the effective vertical and lateral retention forces would be 120 and 40 pounds, respectively, with a link 28 and soleplate 24 with the "A", "B" and "C" dimensions previously stated.

Referring again to the force-displacement curve of FIG. 14, and further assuming a lateral release with a binding having the dimensional and force characteristics, as by twisting the soleplate 24 relative to the ski, point "X" indicates a 40 pound loading when no displacement has occurred. At distance "Y", which corresponds to about one and one-half inches in displacement, the force has dropped substantially, and the link has just exited the V-notch 50 or corresponding space between the guideposts 62. At distance "Z", which in the illustrative case is after about seven inches of displacement, the shock cord forming the leash 26 has substantially reached the limit of its extension.

As is conventional, the soleplate 24 includes a retaining lip 80 under which the toe of the boot 20 is inserted during mounting on the soleplate. Also in accordance with conventional design, the heel of the boot 20 is held secured to the soleplate 24 by means of a toggle latching mechanism 82.

In use, the binding is initially adjustably positioned for normal skiing in alignment and engagement with the underlying ski 22 in the relative position shown in FIG. 3. So long as the forces applied to the boot and ski do not exceed a predetermined safe level, as is the case in normal skiing, no appreciable separation occurs. On the other hand, when abnormally high forces are applied to either the boot or ski, leash 26 extends to permit separation. As will be appreciated, separation forces applied either vertically or sideways at the heel or toe, as both, will initiate the desired leash extension. Moreover, extension of the leash 26 continues as necessary to relieve the separating forces and thereby protect the skier from injury. It will be understood that the rigid links 28 and 34 move out of the fairleads 52, 64, such that the soleplate 24 is freed for relative twisting and tilting with respect to the ski, limited only by the constraints of flexible leash 26.

Once the force causing separation of boot and ski abates, then the elastic characteristic of the leash 26 causes the binding to retract and ultimately return to the normal skiing position illustrated in FIG. 3. It will be understood that retraction automatically commences once the separating force drops below the effective retraction force then being applied by the leash 26 and continues so long as the effective retraction force exceeds the separating force. As the soleplate and ski move back into close proximity to one another during retraction, the rigid links 28 and 24 automatically reengage the soleplate to increase the effective retraction and retention force, thereby restoring the initial relatively high loading previously described and illustrated by the force-displacement graph of FIG. 14.

By virtue of combined release and retraction capability of the binding, the skier is protected against injury in abnormal force situations, yet may be able to retain ski control and thereby avoid a fall. This stems from the fact that the skier remains coupled to the boot by a force-applying link, the force being controlled at all times so as to be at a safe level.

Preferably, as shown in the illustrative embodiment, the rigid links 28 and 34 are adjustably attached to the leash 26, as shown in detail in FIG. 7. In particular, the link 28 comprises an outer tube 86 which is internally threaded to receive an externally threaded plug 88. The plug 88 has an internal bore to receive the leash 26, and the leash has an enlarged end element 90 which prevents inadvertent removal of the leash from the plug. The effective length may therefore be varied by rotating the plug 88 as desired. A lock nut 92 is provided to secure the plug 88 and tube 86 from relative rotation. Moving the plug 88 further into the tube 86 has the effect of reducing the "C" dimension in FIG. 5 and, hence, decreasing the initial retention force between the boot and ski for a given initial loading on the leash 26, conversely, backing the plug 88 out of the tube 86 has the opposite effect.

The soleplate 24 includes a hollow housing through which the leash 26 passes between the ends of the soleplate. The leash passes over a succession of pulleys 94 (FIG. 5), to increase its effective length of the leash and thereby allow a greater maximum displacement of the soleplate 24 from the ski 22 than would otherwise be obtainable. The locations of the pulleys 94 in FIG. 5 is exemplary only, and in no way critical to the invention. As best seen in FIGS. 5 and 6, the soleplate 24 is preferably formed as two telescoping sections, so that its overall length may be adjusted to accommodate various sizes of ski boots. As shown in FIGS. 1–3, the soleplate 24 can be locked at a particular length by means of a screw 96 in one sliding section, acting in cooperation with a slot 98 in the other section.

It is preferable that the soleplate 24 be registered with the ski 22 at the heel end in a transverse sense by means of a tapered upstanding block 100 rigidly mounted on the ski 22. The block 100 engages a corresponding channel 102 (FIG. 11) in the underside of the soleplate 24 as the ski is drawn back toward the soleplate 24 after separation therefrom.

FIGS. 12 and 13 illustrate an alternate form of the invention, and, in particular, an alternate means for coupling the leash 26 to the ski 22. Where possible, elements of this embodiment which have direct equivalents in the aforedescribed embodiment are indicated by the same corresponding reference numerals, but with the numerals shown primed in FIGS. 11 and 12.

The leash 26 emerges from a modified soleplate 24', passes between two pulleys 54', and is secured rigidly to a rigid link 28', which takes the form of a flat plate disposed substantially horizontally when the soleplate 24' is in a fully retracted position with respect to the ski 22. The link or plate 28' is pivotally mounted about a horizontal axis at its forward end to a pivot pin 40', which in turn is free to turn on a vertical axis in its mounting plates 72' and 74'. For the same reasons as were mentioned for the first-described embodiment, the mounting plate 72' is adjustable with respect to the fixed lower mounting plate 74'.

It can be seen from FIG. 12 that the link 28' is pivotable in any direction above the surface of the ski 22 in much the same manner as the link 28 in the previously described embodiment. The link 28' has two laterally projecting wing-like portions 110, and tapers rearwardly along convex edges to a relatively narrow width at its rearward end. Mounted in the soleplate 24' are two guideposts 112 which are located to abut the wing-like portions 110 when the soleplate is in its fully retracted position. The outer coverings of the guideposts 112 are of a resilient material, and have much the same function as the resilient sleeves of the guidepost 62 discussed with respect to the previously described embodiment, i.e., they act to inhibit forward and rearward movement of the soleplate 24' with respect to the ski 22. They also transmit a horizontal separation force between the soleplate 24' and the link 28'.

As can be seen in FIG. 12, the soleplate 24' also has a forwardly and upwardly projecting toe 48' which transmits any upwardly directed separation force from the soleplate 24' to the link 28'.

The dimensional relationships in the embodiment shown in FIGS. 12 and 13 are equivalent to those discussed with respect to the other embodiment. In the embodiment of FIGS. 12 and 13, the rearward end of the soleplate 24' is mounted to the ski 22 by an identical arrangement to the forward end illustrated and described.

It will be appreciated from the foregoing that the present invention provides a ski binding with a desirable automatic boot-to-ski return capability and with desirable force-displacement characteristics, and does so utilizing a relatively simple and inexpensive structural arrangement. It will also be appreciated that, although specific embodiments of the invention have been described in detail for purposes of illustration, various modifications may be made without departing from the spirit and scope of the invention.

We claim:

1. A ski binding comprising:

boot-engaging means adapted for detachable connection to a ski boot;

mounting means adapted for attachment to a ski;

leash means for connecting said boot-engaging means and said mounting means and applying a tension force therebetween to yieldably resist separation of said boot-engaging means and said mounting means, said leash means being extendable to permit said boot-engaging means and said mounting means to separate and retractable to draw them back together;

force-transmitting link means mounted on one of said boot-engaging means and mounting means, and coupled to said leash means; and engagement means on the other of said boot-engaging means and mounting means which engages said force-transmitting link means to vary the effectiveness with which such tension force is applied as a function of leash extension.

2. A ski binding as in claim 1 wherein said force-transmitting link means comprises an elongated member connected on one end to said leash means and mounted for universal pivotal movement at its other end on said one of said boot-engaging means and mounting means.

3. A ski binding as in claim 1 wherein said leash means comprises a shock cord.

4. A ski binding as in claim 1 wherein:

said force-transmitting link means is mounted on said mounting means for universal pivotal movement and said engagement means is on said boot-engaging means; and said leash means is secured to said link means.

5. A ski binding comprising:

boot-engaging means for releasable connection to a ski boot in underlying relation thereto;

heel and toe mounting elements attached to the ski at positions corresponding to the ends of the boot when positioned on the ski in normal skiing relationship;

an elongated, flexible leash formed of shock cord having its opposite ends coupled to said respective mounting elements and having a central portion retained on said boot-engaging means, said leash being prestressed to a minimum tension to provide a force-applying link between said boot-engaging means to separate from said ski and contractable to draw them back together and hold said boot-engaging means in said skiing relationship;

guide means on said boot-engaging means for guiding said leash over a path of sufficient length to allow substantial separation of said boot-engaging means from the ski; and force-controlling means for enhancing the effectiveness with which said leash acts to hold said boot-engaging means in said normal skiing relationship, said force controlling means being disabled when said boot-engaging means and ski have separated a predetermined distance.

6. A ski binding as in claim 5 further comprising means on said boot-engaging means for altering the spacing of said guide means to vary the length of the path of said leash and thereby vary the magnitude of said minimum tension of said leash.

7. A ski binding as in claim 5 wherein said force controlling means includes rigid links secured, one each, to the terminal ends of said leash and mounted for universal pivotal movement on respective ones of said heel and toe mounting elements.

8. A ski binding comprising:

boot-engaging means adapted for detachable connection to a ski boot;

leash means for connecting said boot-engaging means to a ski and applying a tension force therebetween to yieldably resist separation of said boot-engaging means from the ski, said leash means including an elongated, flexible cord;

connecting means for attaching said leash means to said ski; and cooperating means including engagement means carried by said boot-engaging means which engage with a rigid link connected to said cord when said boot-engaging means and ski are in close proximity to one another for enhancing the effectiveness with which said tension force is applied by said leash means between said boot-engaging means and said ski.

9. A ski binding as in claim 8 wherein said cooperating means includes means for adjusting the effectiveness with which said tension force is applied.

10. A ski binding for coupling a ski boot to a ski, comprising;

a soleplate for releasable attachment to the ski boot in underlying relation thereto;

heel and toe mounting elements attached to the ski at positions near the ends of said soleplate when positioned on the ski;

an elongated, flexible leash formed of an elastic material having ends attachable to said respective mounting elements and having a central portion retained in said soleplate, said leash being prestressed to a minimum tension to provide a force-applying link between said soleplate and the ski and being yieldably stretchable to permit said soleplate to separate from said ski and contractable to draw them back together;

a plurality of pulleys on said soleplate to guide said leash over a path of sufficient length that said elastic leash can extend to provide a substantial displacement of said soleplate from the ski;

a pair of rigid force-transmitting links for connecting the ends of said leash pivotally to said heel and toe mounting elements, respectively; and engagement means on said soleplate for engaging said links when said soleplate is in close proximity to said ski and a displacing force is applied to said soleplate, said engagement means acting at a mechanical disadvantage to apply a force to stretch said leash, whereby the effective retention force on said soleplate is relatively high when said soleplate and ski are in close proximity and reduced after they have separated.

11. A ski binding as in claim 10 wherein each of said force-transmitting links is adjustable in length to adjustably establish the effective retention force when said soleplate is in such close proximity to said ski.

12. A ski binding as in claim 10 wherein said soleplate is adjustable in length to accommodate boots of different sizes; and wherein said pulleys are arranged for movement relative to one another responsive to such adjustment of said soleplate length so as to vary the minimum tension on said leash.

13. a ski binding as in claim 10 wherein said engagement means includes upwardly projecting lips on said soleplate associated with the heel and toe mounting elements and located adjacent said elements when said binding is positioned on said ski; and further includes two pairs of generally vertically oriented and inwardly facing engagement surfaces associated with said heel and toe mounting elements and located at greater spacing from said elements than said lips; whereby the effective retention force on said soleplate applicable to displacing forces acting vertically is greater than against such forces acting laterally.

14. A ski binding as in claim 10 wherein said toe mounting element includes stop means engageable with the forward end of said soleplate; and further including spring means operative to urge said soleplate forwardly into engagement with said stop means when said soleplate is in normal skiing position on said ski.

* * * * *